US005273439A

United States Patent [19]

Szerlip et al.

[11] Patent Number: 5,273,439

[45] Date of Patent: Dec. 28, 1993

[54] THERMALLY CONDUCTIVE ELASTOMERIC INTERPOSER CONNECTION SYSTEM

[75] Inventors: Stanley R. Szerlip, Longmont; Floyd G. Paurus, Boulder, both of Colo.

[73] Assignee: Storage Technology Corporation, Louisville, Colo.

[21] Appl. No.: 29,825

[22] Filed: Mar. 11, 1993

[51] Int. Cl.[5] ..... H01R 9/09; H01R 13/533

[52] U.S. Cl. ..... 439/66; 439/485; 439/591; 439/487

[58] Field of Search ..... 439/65-67, 439/206, 485, 487, 493, 591

[56] References Cited

U.S. PATENT DOCUMENTS

| | | | |
|---|---|---|---|
| 3,638,163 | 1/1972 | Loosme | 339/17 |
| 3,904,262 | 9/1975 | Cutchaw | 439/487 |
| 3,985,413 | 10/1976 | Evans | 339/17 |
| 4,082,407 | 4/1978 | Smorzaniuk et al. | 439/487 |
| 4,693,530 | 9/1987 | Stillie et al. | 439/66 |
| 4,795,079 | 1/1989 | Yamada | 439/485 |
| 5,032,897 | 7/1991 | Mansuria et al. | 357/81 |
| 5,035,628 | 7/1991 | Casciotti et al. | 439/66 |
| 5,037,311 | 8/1991 | Frankeny et al. | 439/66 |
| 5,102,343 | 4/1992 | Knight et al. | 439/591 |
| 5,123,849 | 6/1992 | Deak et al. | 439/591 |
| 5,127,837 | 7/1992 | Shah et al. | 439/66 |

*Primary Examiner*—Paula A. Bradley

*Attorney, Agent, or Firm*—Sheridan Ross & McIntosh

[57] ABSTRACT

A multi-chip module electrical and thermal conducting apparatus is provided. The apparatus is disposed between layers or boards of the module and includes electrical conducting traces. Electrical conductors are deposited on the faces of the layers and the traces electrically interconnect the electrical conductors of the two layers. The traces are joined to an elastomeric body and insulating material that are essentially non-conductive of electrical and thermal energy. The apparatus includes a thermal conduction unit that acts as a thermal shunt around the body and insulating material. The thermal conduction unit is electrically isolated from the traces. Thermal energy is received by the thermal conduction unit when heat is generated by the activation of electronic components mounted on the module layers. The thermal energy received by the thermal conduction unit is carried away by thermal vias formed in the module layers.

11 Claims, 4 Drawing Sheets

THERMALLY CONDUCTIVE ELASTOMERIC INTERPOSER CONNECTION SYSTEM

FIELD OF THE INVENTION

The present invention relates to a thermal conductive device and, in particular, to a thermal conductor that acts as a thermal shunt as part of an electrical interconnection apparatus used in a three-dimensional multiple chip module.

BACKGROUND OF THE INVENTION

Computer hardware systems utilize stacked printed circuit (PC) boards having electrical components mounted thereon. These components primarily include integrated circuits chips (ICs). During operation, the components and boards are heated due to the electrical energy or power dissipated by the components or chips. It is necessary that these elements be cooled or heat removed therefrom. Known cooling technology for modules having a number of stacked or aligned layers or boards having electronic components includes the use of heat pipes, liquid cooling and diamond films on ceramic or silicon. Cooling systems that employ such technology are relatively expensive, tend to be complicated and occupy considerable space. In another technique, a thermal electrically cooled integrated circuit package is described in U.S. Pat. No. 5,032,897, issued Jul. 16, 1991 and entitled "Integrated Thermal Electric Cooling." The integrated circuit package disclosed in this patent acts by itself to dissipate thermal energy generated by the IC chip.

In the field of stacked or interconnected PC boards, interposer connectors have been proposed and developed for electrically interconnecting electrical conductors provided on the stacked boards. In U.S. Pat. Nos. 3,638,163, issued Jan. 25, 1972 entitled "Connector for Electrically Interconnecting Two Parallel Surfaces" and 3,985,413, issued Oct. 12, 1976 entitled "Miniature Electrical Connector," such devices are described. Generally, each includes an elastomeric body having a number of conductors spatially disposed along the length of the body. An insulating material is located between the conductors. The body and the accompanying electrical conductors are positionable between two substrates, with the electrical conductors providing the desired electrical connection between substrate conductors found on the two boards Relatedly, U.S. Pat. No. 5,035,628, issued Jul. 30, 1991 and entitled "Electrical Connector for Electrically Interconnecting Two Parallel Surfaces" describes a housing for surrounding the interposer body having the electrical conductors. The housing is fastened between two circuit boards.

SUMMARY OF THE INVENTION

In accordance with the present invention, an apparatus is disclosed that includes a thermal conducting device that shunts around non-thermal conductive material, which is part of an electrical conductor interconnect unit. The apparatus includes a resilient body that is made of a material that essentially does not conduct electrical energy and thermal energy. Spaced electrical conductors or traces are joined to the body, with each electrical trace being insulated from all other traces using electrical insulating material. The apparatus further includes a thermal conduction unit that acts as a thermal shunt relative to the elastomeric body and electrical insulating material. Like the electrical traces, the thermal conduction unit is disposed between stacked layers having electrical components with the unit contacting a thermally conductive element provided on each of the two layers or substrates. These thermally conductive elements on the two layers are electrically isolated from the electrical conductors disposed on the stacked layers. The thermal conduction unit preferably has a length substantially equal to the length of the resilient body. At the same time that the spaced electrical conductors are providing a path for electrical energy or signals between adjacent layers or boards, the thermal conduction unit is receiving and is able to carry or transmit thermal energy away from the stacked layers. In one embodiment, a thermal via is formed through each of the stacked layers and thermally conducts the heat energy from the thermal conduction unit to a desired heat receiving source, such as a heat sink.

The thermal shunt function of the present invention can be incorporated into a number of different embodiments. In one embodiment, the electrical insulating material is a sheath that surrounds the resilient body. The electrical traces are positioned over the sheath and spaced from each other. The sheath material between the traces acts as an electrical insulator. The thermal conduction unit is connected to, or at least parts thereof are integrally formed with, the resilient body. In one embodiment, the thermal conduction unit includes inner core material that is the same as the insulating material of the resilient body. An outer layer of thermal conducting material surrounds the inner core material. A space is defined between the thermal conductive outer layer and the electrical traces, which serves to electrically isolate the traces from the thermal conductive outer layer. In another embodiment, the thermal conduction unit is of a homogeneous or uniform structure throughout, such as being made of a solid copper bar. This thermal conduction unit is also connected to the resilient body and a space is provided between the electrical traces and the thermal conduction unit. In still another embodiment, the resilient body includes a number of non-conductive substrates. Between each two substrates, a number of spaced electrical conductors are deposited on the faces of the substrates. The substrate material itself acts as the insulator between the spaced electrical conductors. The thermal conduction unit is attached to or formed as a part of this particular combined substrate body. The thermal conduction unit is electrically insulated from the deposited electrical conductors using one of the substrates.

Based on the foregoing summary, a number of advantages of the present invention are identified. An apparatus is provided for carrying thermal energy away from electronic components in a module having stacked layers or boards with electrical conductors. The apparatus effectively provides a thermal shunt around non-thermally conductive interposer or interconnect material. Accordingly, while the electrical traces of the apparatus are providing an electrical path, a thermal conduction unit is providing a thermal energy path. The thermal conduction unit is appropriately disposed relative to electrical traces so that there is no contact and no short circuit between electrical conductors on the stacked layers and the spatially disposed electrical conducting traces. Additionally, advantageously located thermal vias are formed in the stacked layers to carry or transmit thermal energy to a desired heat receiving source.

Additional advantages of the present invention will become readily apparent from the following discussion, particularly when taken together with the accompanying drawings.

DETAILED DESCRIPTION

Figure 1:
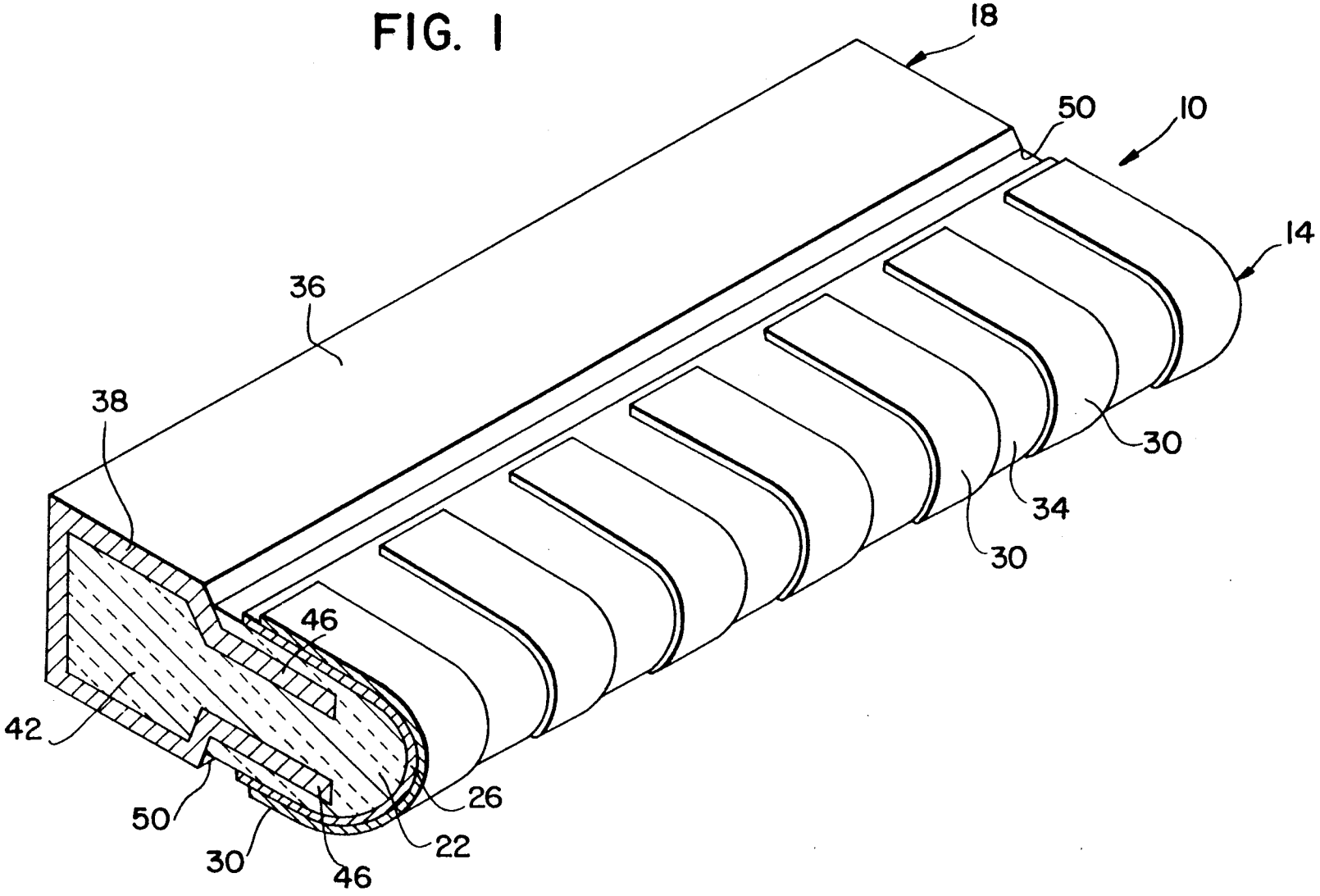
FIG. 1 is a perspective view of an electrical conducting and thermal conducting apparatus of the present invention.

With reference to FIG. 1, an apparatus 10 is illustrated for providing a thermal shunt around thermally non-conductive material that is part of an electrical interconnect or interposer unit 14. The shunt comprises a thermal conduction unit 18 for conducting thermal energy, e.g., heat generated during the operation or activation of electronic components that are part of a printed circuit (PC) board or layer of a three-dimensional multi-chip module.

The electrical interconnection unit 14 includes an interposer body 22 which, in the embodiment of FIG. 1, is elongated and has a curved portion along one side of its length and a substantially straight portion along its opposite side. The interposer body 22 is made of an electrically non-conductive material, such as silicon rubber. The silicon rubber is also substantially nonconductive of thermal energy. An insulation member 26 surrounds or wraps around the outer or exterior surface of the interposer body 22. In one embodiment, the insulation member 26 is a polyimide sheath. Disposed on the exterior or outer layer of the insulation member 26 is an electrical conducting member, which is comprised of a number of electrical conducting traces 30. The traces 30 are formed or provided to be spaced apart along the length of the interposer body 22 and the insulation member 26. The traces 30 are made of an electrically conductive material, such as copper. The traces 30 are able to provide electrical conduction between conductors or conducting lines in which they are in contact. The spaces between the electrical conducting traces 30 are occupied by insulating sections 34 of the insulation member 26. The insulating sections 34 are of a width to provide the necessary electrical isolation between each of the conductive traces 30 and avoid any shorting between one or more of the traces 30. These traces 30 are typically 0.03 inch in width with 0.005–0.007 inch separation which yields a typical pitch of 0.008–0.010 inch.

When the electrical interconnection unit 14, by means of the electrical conducting traces 30, is utilized to provide a desired electrical connection between spaced electrical conductors, the interposer body 22 is not capable of acting as an acceptable receiver or conductor of thermal energy. The thermal energy is commonly generated by the electronic components mounted on layers or boards between which the electrical interconnection unit 14 is located. The silicon rubber composition of the interposer body 22 has an extremely low thermal conductivity, i.e., about 0.13 Btu × ft/hr x sq ft x F. The interposer body 22 therefore cannot be effectively utilized as a thermal conductor. Likewise, the polyimide sheath 26 has a very low thermal conductivity of about 0.57 Btu × ft/hr × sq ft × F.

The thermal conduction unit 18 is operatively associated with the electrical interconnection unit 14 to provide the thermal energy accepting characteristic, and provides a desired path for thermal energy that cannot be effectively provided by the electrical interconnection unit 14. As seen in FIG. 1, in this embodiment, the thermal conduction unit 18 includes a substantially elongated block or body 36 having an outer member 38 and an inner core member 42. The outer member 38 is of sufficient thickness to act as an effective heat receiving and conducting element and the inner core member 42 is made essentially of a thermally non-conductive element. In the embodiment illustrated in FIG. 1, the inner core member 42 is made of the same material as the interposer body 22. In providing the desired interconnection between the thermal conduction unit 18 and the electrical interconnection unit 14, the outer member 38 includes legs 46 that extend from the body 36 into the interior of the interposer body 22. The outer member 38 of the body 36 is preferably made of copper, which has a substantially greater thermal conductivity than that of the interposer body 22 material, i.e., the thermal conductivity of copper is about 226 Btu × ft/hr × sq ft × F. To provide electrical isolation between the thermal conduction unit 18 and the traces 30 of the electrical interconnect unit 14, a space or discontinuous area 50 is formed therebetween on both upper and lower portions of the apparatus 10, with the area 50 being comprised of the body 22.

Figure 2:
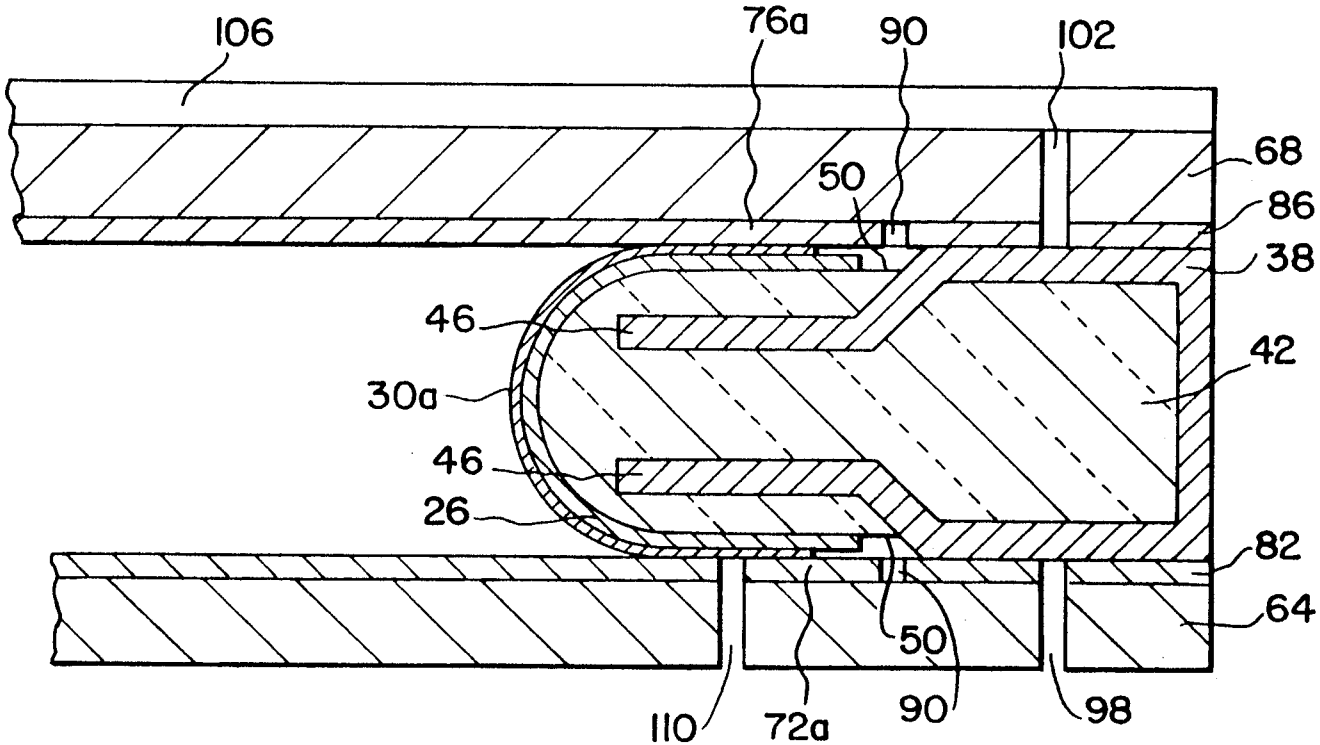
FIG. 2 is a lateral section of the apparatus of FIG. 1 and illustrates the thermal contact between the thermal conduction unit and a thermal conductive element provided on each layer of the module, together with the electrical contact between the electrical conducting traces and the electrical conductors found on the stacked layers, as well as illustrating thermal energy paths relative to the thermal conduction unit.
Figure 3:
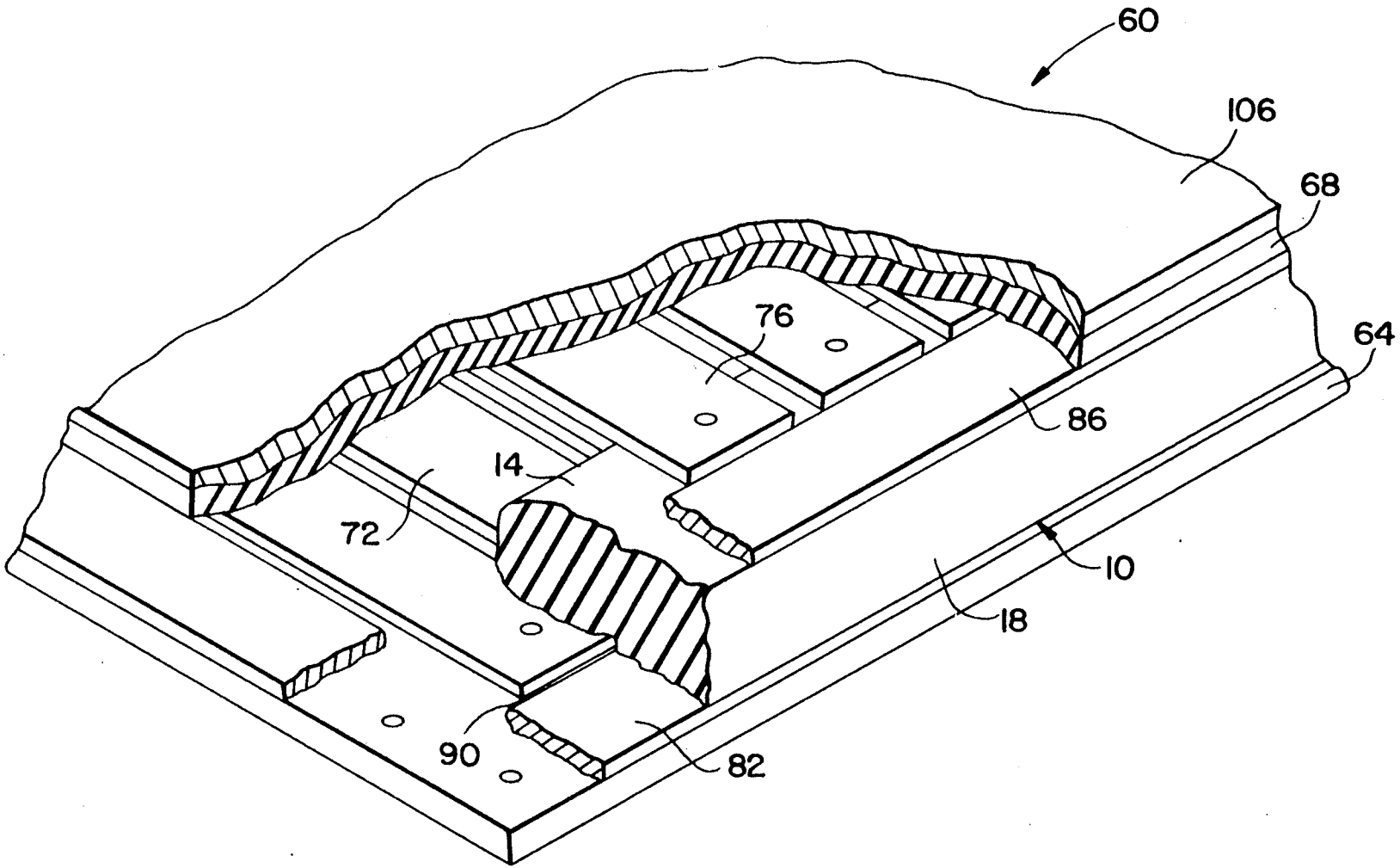
FIG. 3 is a fragmentary perspective view illustrating thermal and electrical connection between two stacked layers using the apparatus of the present invention.

In next describing in greater detail the thermal conductive property of the apparatus 10, reference is made to FIGS. 2 and 3. In FIG. 3, parts of an electronic hardware module 60 are illustrated. The module 60 may typically be used in computer or computer peripheral systems and commonly includes a number of layers or substrates arranged in a stacked relationship in which the layers are aligned. Each of the layers has electronic components or integrated circuit chips mounted thereon and, as is commonly done, interconnection parts or systems are utilized to electrically interconnect components or conductors on one layer with components or conductors on one or more layers in the module 60.

In conjunction with the explanation of the present invention, in the illustration of FIG. 3, the module 60 includes a first layer or board 64 and a second layer or board 68, although more boards could be provided in the stacked, aligned relationship. Each of the two layers 64, 68 has a number of electrical conductors. The first layer 64 has electrical conductors 72 extending in one dimension along the first layer 64. Electrical conductors 76 are provided on the second layer 68 and also extend in one direction along a dimension of the second layer 68. The electrical conductors 72 and the electrical conductors 76 are provided on surfaces of their respective layers or boards 64, 68 such that they face each other and the length of the electrical conductors 72, 76 may be short enough to be conductive pads only and the actual electrical connection is made by traces internal to the module 60, which is the likely implementation. The electrical conductors 72, 76 carry electrical signal information when the components to which they are electrically connected are being used.

The spaced relationship and the desired electrical interconnection between one or more conductors 72 and one or more conductors 76 is achieved using the apparatus 10. As seen in FIG. 2, one of the electrical conducting traces 30*a* has a first portion in electrical contact with an electrical conductor 72*a* provided on the first layer 64 and a second portion in electrical contact with an electrical conductor 76*a* provided on the second layer 68. By this arrangement, an electrical signal conducting path is provided between the conductors 72*a* and 76*a*.

The thermal conduction unit 18, as seen in FIG. 3, provides a thermal energy path between the two layers 64, 68. In connection with providing a thermal energy path, the first layer 64 includes a thermal conductor element or strip 82 that extends along the same surface of the first layer 64 as does the electrical conductors 72 but in a direction substantially perpendicular thereto. The thermal conductor element 82 is made of a thermally conductive material, such as copper, and has a sufficient width to provide an effective thermal path for the transfer of heat relative to the thermal conduction unit 18. Likewise, the second layer 68 has a thermal conductor element or strip 86 that extends in one direction along a dimension of the second layer 68 and is aligned in a spaced relationship with the thermal conductor element 82. The thermal conductor elements 82, 86 are located on surfaces of the first layer 64 and the second layer 68, respectively, so that they face each other. As also seen in FIG. 3, an electrical/thermal isolating gap 90 is formed or maintained between each of the thermal conductor elements 82, 86 and their respective electrical conductors 72, 76. This spacing or arrangement ensures that no electrical shorts are created by the thermal conductor elements 82, 86 relative to the electrical conductors 72, 76.

As seen in FIG. 2, the gap 90 must be of a dimension and a position so that each gap 90 is aligned with the space between the thermal conductive body 36 and the electrical conducting traces 30. This provides electrical isolation for the thermal conduction unit 18, while the thermal conductive body 36 provides a path for thermal energy. In that regard, as seen in FIG. 2, a lower part of the outer member 38 sufficiently contacts the thermal conductor element 82 of the first layer 64 to act as a thermal energy conductor and heat transfer means using the intermediate portion of the thermal conductor body 36 that extends between the two layers 64, 68. An upper part of the outer member 3 is integral with the intermediate portion and is in sufficient contact with the thermal conductor element 86 of the second layer 68 for similarly acting as a conductor of thermal energy.

A thermally conductive epoxy or paste that conducts only normally to the planes of the layers 64, 68 can be applied to the outer surfaces of the thermal conductor elements 82, 86 in order to enhance thermal energy transfer. Accordingly, the thermal conduction unit 18 is able to receive heat generated as a result of the operation or activation of electronic components mounted to the layers 64, 68. In one embodiment, thermal vias 98, 102 receive and transport the thermal energy relative to the thermal conduction unit 18.

Thermal via 98 is formed through the first layer 64 and the thermal conductor element 82 and contacts the surface of the lower part of the thermal conductive body 36. The thermal via 98 is made of a thermal energy conductive material, such as copper, and is of a width or size to provide a thermal energy path relative to another layer that could be aligned with the first layer 64. In connection with terminating the thermal energy path, in one embodiment, the thermal via 102 extends through the electrical conductor 86 and the second layer 68 for contact with a heat sink 106. The thermal via 102 is able to carry or transport thermal energy from the thermal conduction unit 18 to the heat sink 106 where heat energy is dissipated. In addition to thermal vias, electrical vias can also be formed in one or both of the layers 64, 68. An electrical via 110 is formed through an electrical conductor 72*a* and the first layer 64 so that an electrical signal path is provided between the first layer 64 and an adjacent layer (not shown).

Figure 5:
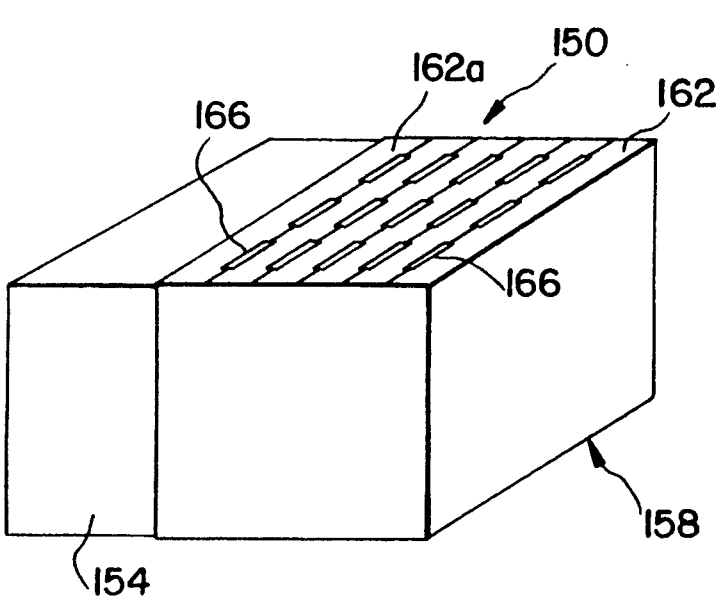
FIG. 5 is a perspective view of still another embodiment of an electrical conducting and thermal conducting apparatus in which the interposer body is comprised of a number of substrates joined together with spaced electrical traces located between the substrates and the thermal conduction unit connected to one of the outer substrates.
Figure 4:
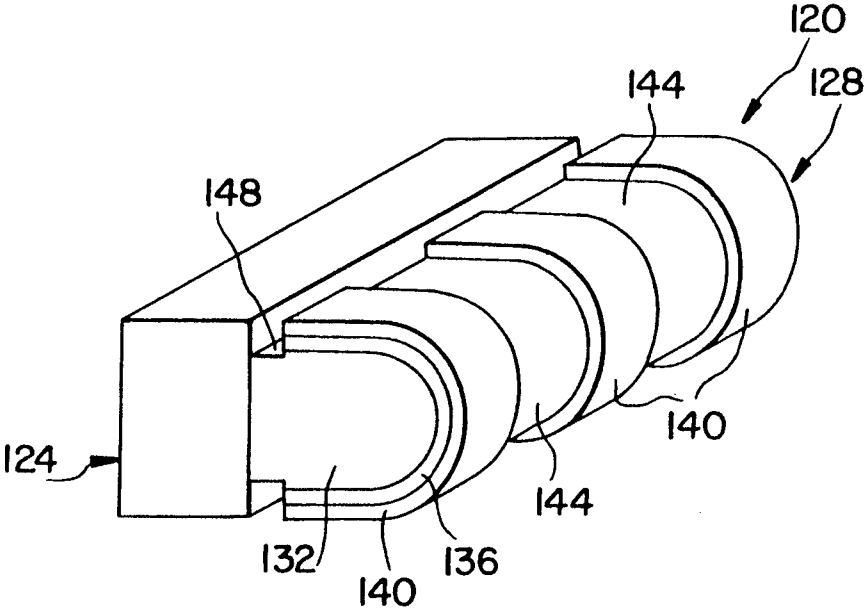
FIG. 4 is a perspective view of another embodiment of an electrical conducting and thermal conducting apparatus in which the thermal conduction unit is of a homogeneous structure.

Further embodiments of the present invention are illustrated in FIGS. 4 and 5. In FIG. 4, an apparatus 120 for shunting thermal energy relative to an interposer is illustrated in which a thermal conduction unit 124, which is made substantially only of thermal conducting material, such as copper, is joined to one side of an electrical interconnect unit 128 along its length. Unlike the previous embodiment, the thermal conduction unit 124 does not include material from which the interposer body 132 is made. As with the first embodiment, the interposer body 132 of the electric interconnect unit 128 is made of silicon, which is essentially a non-conductive material. A polyimide sheathing 136 is wrapped around the exterior surface of the interposer body 132. Electrical conducting traces 140 are formed about the exterior surface of the sheath 136, with sections 144 of the sheath 136 electrically isolating adjacent traces 140. A space 148 is provided between the thermal conduction unit 124 and the electrical traces 140 in order to prevent short circuits therebetween.

Another embodiment of the present invention for shunting an interposer connector is illustrated in FIG. 5. The apparatus 150 includes a thermal conduction unit 154 made of a thermally conductive material, such as copper. The thermal conduction unit 154 is joined to an electrical interconnect unit 158. In this embodiment, the unit 158 includes a number of substrates 162 that are joined together along planar surfaces thereof. A plurality of electrical conductors or wires 166 are positioned between each of the substrates 162 before they are joined or compressed together. The wires 166 are open or available at the top and bottom surfaces of the electrical interconnect unit 158 for providing desired electrical interconnection between adjacent layers or boards. The substrates 162 are made of a material that essentially does not conduct thermal energy and electrical energy, such as the same material that is used in making the resilient body for the other embodiments, namely, silicon rubber. This non-conductive material also acts to insulate the thermal conduction unit 154 so that it does not act as a short circuit to the electrical conductors 166. In particular, the substrate 162*a* electrically isolates the electrical conductors 166 from the thermal conduction unit 154. As with the first embodiment, the embodiments of FIGS. 4 and 5 are disposed between layers or boards in a multi-chip module to provide electrical interconnection between electrical conductors formed on the boards, as well as providing a thermal shunt relative to the electrical interconnect unit.

The foregoing description of the invention has been presented for purposes of illustration and description. Further, the description is not intended to limit the invention to the form disclosed herein. Consequently, variations and modifications commensurate with the above teachings, within the skill or knowledge of the relevant art, are within the scope of the present invention, particularly embodiments where a thermal conductor acts as a thermal shunt around insulating sheathing and/or interposer material. The embodiment described hereinabove is further intended to explain the best mode presently known of practicing the invention and to enable others skilled in the art to utilize the invention as such, or other embodiments, and with the various modifications required by their particular application or uses of the invention. It is intended that the appended claims be construed to include alternative embodiments to the extent permitted by the prior art.

What is claimed is:

1. An apparatus for electrically connecting a number of electrical conductors of a first layer with a number of electrical conductors of a second layer while simultaneously providing thermal conduction between the first and second layers, comprising:

a resilient body disposable between first and second layers of a module;

a plurality of electrical conducting traces spaced from each other along a length of said body and having portions outward of said body for providing electrical interconnection between electrical conductors of the two layers;

insulating material for electrically insulating said electrical conducting traces from each other; and a thermal conduction unit adjacent to said body and extending along at least portions of the length of said body, said thermal conduction unit for receiving and conducting thermal energy associated with the two layers.

2. An apparatus, as claimed in claim 1, wherein:

said thermal conduction unit has a length substantially corresponding to said length of said body.

3. An apparatus, as claimed in claim 1, wherein:

said thermal conduction unit includes portions having a thermal conductivity at least 100 times greater than the thermal conductivity of material from which said body is made.

4. An apparatus, as claimed in claim 1, wherein:

said thermal conduction unit is connected to said body and includes at least an outer layer of a thermal conducting material with said outer layer being electrically isolated from said electrical conducting traces.

5. An apparatus, as claimed in claim 2, wherein:

said thermal conduction unit is homogeneous and made substantially only of thermal conduction material.

6. An apparatus, as claimed in claim 4, wherein:

said thermal conduction unit includes an inner core of material that is substantially less conductive than said outer layer.

7. An apparatus, as claimed in claim 4, wherein:

said outer layer extends into said body with portions of said outer layer being disposed inwardly of said electrical conducting traces.

8. An apparatus, as claimed in claim 1, further comprising:

heat transfer means in contact with said thermal conduction unit for carrying heat away therefrom, said heat transfer means being made of thermal conducting material and extending along a portion of at least one of said first and second layers of said module.

9. An apparatus, as claimed in claim 8, wherein:

said heat transfer means includes a thermal energy conductive element connected to each of said first and second layers, with each of said first and second thermal energy conductive elements being electrically isolated from electrical conductors of said first and second layers.

10. An apparatus, as claimed in claim 8, wherein:

said heat transfer means includes at least a first thermal energy conductive element connected to one of the two layers, with the one layer having a plurality of electrical conductors, said first thermal energy conductive element being substantially perpendicular to the electrical conductors.

11. An apparatus, as claimed in claim 10, wherein:

each of said thermal energy conductive elements is spaced from electrical conductors on the layers, with said spacing being aligned with a gap between said electrical conducting traces and said thermal conduction unit.

* * * * *